US009656777B2

(12) United States Patent
Flaming

(10) Patent No.: US 9,656,777 B2
(45) Date of Patent: May 23, 2017

(54) STACKABLE CONTAINER BLANK, STACKABLE CONTAINER, AND METHOD FOR MAKING THE SAME

(71) Applicant: Max Flaming, Fresno, CA (US)

(72) Inventor: Max Flaming, Fresno, CA (US)

(73) Assignee: Maxco Supply, Inc., Parlier, CA (US)

( * ) Notice: Subject to any disclaimer, the term of this patent is extended or adjusted under 35 U.S.C. 154(b) by 0 days.

(21) Appl. No.: 14/946,690

(22) Filed: Nov. 19, 2015

(65) Prior Publication Data

US 2016/0144994 A1 May 26, 2016

Related U.S. Application Data

(60) Provisional application No. 62/084,230, filed on Nov. 25, 2014, provisional application No. 62/090,837, filed on Dec. 11, 2014.

(51) Int. Cl.
*B65D 21/032* (2006.01)
*B65D 5/00* (2006.01)

(52) U.S. Cl.
CPC ..... *B65D 5/0015* (2013.01)

(58) Field of Classification Search
CPC ..... B65D 5/0015; B65D 5/22; B65D 21/0212
USPC ..... 229/117.25, 174, 178, 915, 919
See application file for complete search history.

(56) References Cited

U.S. PATENT DOCUMENTS 6,460,758 B1 * 10/2002 Fenton ..... B65D 5/0035 206/509
6,502,698 B1 * 1/2003 McKenna ..... B65D 5/0015 206/509
2009/0272789 A1 * 11/2009 Fry ..... B65D 5/0015 229/5.5
2013/0048704 A1 * 2/2013 Lewis ..... B65D 5/0015 229/190

FOREIGN PATENT DOCUMENTS

WO WO-2013/121343 A1 * 8/2013 ..... B65D 21/0212

* cited by examiner

*Primary Examiner* — Gary Elkins
(74) *Attorney, Agent, or Firm* — Andrew D. Fortney; Central California IP Group, P.C.

(57) ABSTRACT

A container blank, a stackable container, and a method for making a stackable container are disclosed. The container blank includes a base having first and second pairs of opposed base edges, end walls foldably attached to the first base edges, and side walls foldably attached to the second base edges. Each side wall has an outer wall foldably attached to the second base edge along a first fold line, at least one index fold-down flap attached to the outer wall along a second fold line, and an inner wall or inner wall flaps foldably attached to the outer wall along a third fold line. Each index flap has a distal portion with notched or expanding extensions, and optionally, a border at a first angle of less than 90° from the second fold line. The stackable container is made from the container blank (e.g., by the method).

17 Claims, 4 Drawing Sheets

STACKABLE CONTAINER BLANK, STACKABLE CONTAINER, AND METHOD FOR MAKING THE SAME

RELATED APPLICATIONS

This application claims the benefit of U.S. Provisional Patent Application Nos. 62/084,230 filed on Nov. 25, 2014, and 62/090,837, filed on Dec. 11, 2014, each of which is incorporated herein by reference in its entirety.

FIELD OF THE INVENTION

The present invention generally relates to the field of containers. More specifically, embodiments of the present invention pertain to a stackable container blank, a stackable container made from the blank, and a method of making the same.

DISCUSSION OF THE BACKGROUND

Certain stackable containers (e.g., trays for carrying and/or shipping fresh produce, such as fruit) sometimes include index tabs or projections from side walls of the container that can be inserted into slots in an overlying container of the same design. Such index tabs or projections are formed by cutting the material of the side wall between a fold line and an outermost periphery or border of the container blank in a shape corresponding to the index tab or projection. Such cuts are generally made at a 90° angle to the fold line. When folding material in the side wall to form the index tabs or projections, sometimes the edge of the side wall contacts the edge of the index tab or projection. The force of this edge-to-edge contact can cause the index tab or projection to bend or fold at a location other than the fold line.

In addition, some of these index tabs or projections also include extensions projecting perpendicularly from an outermost or distal portion of the index tab or projection. Such extensions from the index tab or projection are substantially straight, or have a substantially straight edge nearest to the fold line. Such extensions generally help secure a part of the index tab or projection between inner and outer walls of the side wall. The straight edge of the extension nearest the fold line generally results in full contact between the extension and the inner side wall during the folding process, which can cause the extension to bend or fold, and result in the weakening of the index tab or projection and/or loss of the intended function of the extension.

This "Background" section is provided for background information only. The statements in this "Background" are not an admission that the subject matter disclosed in this "Background" section constitutes prior art to the present disclosure, and no part of this "Background" section may be used as an admission that any part of this application, including this "Background" section, constitutes prior art to the present disclosure.

SUMMARY OF THE INVENTION

Embodiments of the present invention relate to stackable container blanks, stackable containers, and methods for forming stackable containers (e.g., by folding and gluing the blanks).

A first aspect of the present invention concerns a container blank. The container blank generally comprises (a) a base having a first pair of opposed base edges and a second pair of opposed base edges, (b) end walls, each end wall foldably attached to one of the first base edges, and (c) side walls, each side wall foldably attached to one of the second base edges. Each of the side walls comprises (i) an outer wall foldably attached to the second base edge along a first fold line, (ii) at least one index fold-down flap attached to the outer wall along a second fold line, each index flap having (1) a distal portion with notched or expanding extensions or (2) a border at a first angle of less than 90° from the second fold line and a distal portion with extensions therefrom, (iii) and an inner wall or a plurality of inner wall flaps, foldably attached to the outer wall along a third fold line. The third fold line is closer to the first fold line than is the second fold line.

In various embodiments, each side wall comprises the inner wall. Alternatively, each side wall comprises the plurality of inner wall flaps. In some embodiments, each outer wall of the side walls has a portion between the second fold line and the third fold line having a border at a second angle greater than 90° from the second fold line. The second angle may be about 95° to 110° with respect to the second fold line. A sum of the first and second angles may be about 180°. Alternatively or additionally, each outer wall may have a portion between the second and third fold lines having a width that increases linearly from the second fold line to the third fold line. A width of the inner wall may be substantially equal to or slightly less than a width of the outer wall. Typically, the second and third fold lines are substantially parallel to the first fold line.

In various embodiments, each of the side walls further comprises extension flaps foldably attached to opposed sides of the side wall, along extension fold lines approximately parallel to the first pair of base edges. In further embodiments, each of the outer walls may include first extension flaps foldably attached to opposed sides of the outer wall along first extension fold lines, and each of the inner walls may include second extension flaps foldably attached to opposed sides of the inner wall, along second extension fold lines. Each of the first and second extension fold lines may be approximately parallel to the first pair of base edges.

In exemplary embodiments, each side wall comprises two index fold-down flaps. The inner wall may have a border with the index fold-down flap(s) at a third angle with respect to the third fold line, and a sum of the first and third angles is substantially equal to 180°. In some embodiments, each index fold-down flap has a border at a first angle of less than 90° from the second fold line. The first angle may be about 70° to 85° with respect to the second fold line. In additional or alternative embodiments, the index fold-down flap has a width that decreases linearly from the second fold line to the distal portion. An edge of the index fold-down flap and an edge of either the inner wall or one of the inner wall flaps may be separated by a cut line in the blank.

In exemplary embodiments, each extension of the index fold-down flap(s) comprises notched or expanding extensions. Generally, the extensions extend a first length from the distal portion of the index fold-down flap. The extensions may have a first width at a location proximate to the distal portion and a second width greater than the first width at a location distal from the distal portion. The second width may be at least 10%-20% greater than the first width. In some embodiments, the first length may be from 50% to 200% of the first width.

In various embodiments, the extensions may have a curved edge. In further embodiments, extensions may have a concave curved edge at the location proximate to the distal portion and a convex curved edge at the location distal from the distal portion. Additionally and/or alternatively, the extensions may have a knob- or hook-like shape. When the index fold-down flaps and the inner wall or the inner wall flap(s) are folded, the extensions are covered by the inner wall or inner wall flap(s).

In exemplary embodiments, the base may include one or more slots configured to receive a folded index tab of another container. Typically, the slot has a width equal to or greater than the length of the second fold line. When the index fold-down flap is folded, it forms an index tab or projection that is configured to fit into one of the slots.

In further embodiments, each of the outer walls and each of the inner walls may include one or more holes configured to provide an opening for air flow. The hole(s) in the outer and inner walls overlap when the inner wall is folded onto the outer wall.

A second aspect of the present invention concerns a stackable container. The stackable container generally comprises (a) a base having a first pair of opposed base edges and a second pair of opposed base edges, (b) end walls, each end wall foldably attached to the first base edges at an angle of from about 80° to about 100°, and (c) side walls, each side wall foldably attached to one of the second base edges. Each of the side walls comprises (i) an outer wall foldably attached to the second base edge along a first fold line at an angle of from about 90° to about 100°, (ii) at least one index tab comprising an index fold-down flap foldably attached to the outer wall along a second fold line at an angle of about 180°, each index fold-down flap having a distal portion with notched or expanding extensions therefrom, and optionally, a border at an angle of less than 90° from the second fold line, and (iii) an inner wall or a plurality of inner wall flaps foldably attached to the outer wall along a third fold line at an angle of about 180°. The notched or expanding extension is between the inner and outer walls, and the third fold line is closer to the first fold line than is the second fold line. Typically, each of the side walls comprises two index tabs.

In exemplary embodiments, each of the notched or expanding extensions contacts a first surface of the outer wall and a first surface of either the inner wall or one of the inner wall flaps to secure the index fold-down flap in place. The first surfaces of the outer wall and the inner wall or the one of the inner wall flaps generally face each other. Generally, the inner wall has a height that is substantially equal to the height of the outer wall. In some embodiments, each outer wall has a portion between the second fold line and the third fold line having a border at an angle of greater than 90° from the third fold line. Additionally, an adhesive may be between each index fold-down flap and the outer wall. Additionally or alternatively, the adhesive may be between the inner wall and the outer wall and/or between each first extension flap and the end wall.

In various embodiments, each of the side walls (e.g., outer side walls) further comprises extension flaps foldably attached to opposed sides of the side walls at an angle of about 80° to 100° along first extension fold lines approximately parallel to the first pair of base edges, and affixed to one of the end walls. In further embodiments, each of the inner walls further comprises second extension flaps foldably attached to opposed sides of the inner wall at an angle of about 80° to 100° along second extension fold lines approximately parallel to the first pair of base edges, and affixed to one of the first extension flaps or one of the end walls. In exemplary embodiments, there may be adhesive between each first extension flap and the end wall, and between either (1) each second extension flap and the end wall or (2) each first extension flap and the second extension flap.

Each of the first extension flaps may be foldably attached to the end wall at an angle of about 90° to the outer wall, such that the first extension flaps are parallel with the end walls, and perpendicular to the side walls. Each of the second extension flaps may also be foldably attached to the first extension flap at an angle of about 90° to the inner wall, such that the second extension flaps are parallel with the first extension flaps and the end wall, and perpendicular to the side walls.

A third aspect of the present invention concerns a method of making a stackable container. The method generally comprises (a) folding two opposing end walls of a stackable container blank to form angles of about 80° to about 100° with respect to a base at a first pair of opposed edges of the base, (b) folding side walls at a second pair of opposed base edges along a first fold line to form an angle of about 90° to about 100° with respect to the base, (c) folding one or more index fold-down flaps foldably attached to an outer wall of the side wall along a second fold line at an angle of about 30°-150°, each index fold-down flap having a distal portion with notched or expanding extensions therefrom, and (d) for each of the side walls, folding an inner wall or a plurality of inner wall flaps foldably attached to the outer wall along a third fold line at an angle of about 180° with respect to the outer wall to form an index tab from the index fold-down flap, such that the notched or expanding extensions are between the inner and outer walls. As for the container blank and the stackable container, the third fold line is closer to the first fold line than is the second fold line.

In various embodiments, each side wall may be attached to each end wall to form an angle of from about 80° to about 100° with respect to the base and with respect to each other. In further embodiments, slots may be formed in the base at or along the first fold line at positions corresponding to the index tabs.

Each of the index fold-down flaps and either the inner wall or each of the plurality of inner wall flaps may be adhesively attached to a corresponding one of the outer walls. First extension flaps foldably attached to each of the outer walls may be affixed to the end walls at an angle of about 90° with respect to the outer walls, such that the first extension flaps are approximately parallel to the end walls. In further embodiments, second extension flaps foldably attached to each of the inner walls or to outermost ones of the inner wall flaps may be affixed to either the end walls or to the first extension flaps at an angle of 90° with respect to the side wall, such that the second extension flaps are parallel with the first extension flaps and the end walls. In exemplary embodiments, the second extension flaps are adhesively attached to a unique one of the first extension flaps.

Embodiments of the present invention can advantageously provide a reliable design and/or approach for making a stackable container from a blank, whereby flutes on the load-bearing wall and on index tabs for stacking the containers are covered, thereby reducing moisture collection in the load-bearing walls of the container. The extensions on the index tabs help to secure the index tabs in place, and reduce the risk of damage to the index tabs. However, unlike prior index tabs and index tab extensions, the present index tabs and index tab extensions do not bend or fold as easily (e.g., in places where they are not intended to fold), which improves the production yield of containers having such index tabs with securable extensions and increases the useful lifetime of such index tabs. These and other advantages of the present invention will become readily apparent from the detailed description below.

DETAILED DESCRIPTION

Reference will now be made in detail to various embodiments of the invention, examples of which are illustrated in the accompanying drawings. While the invention will be described in conjunction with these embodiments, it will be understood that the invention is not intended to be limited to these embodiments. On the contrary, the invention is intended to cover alternatives, modifications, and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, and components have not been described in detail so as not to unnecessarily obscure aspects of the present invention.

For the sake of convenience and simplicity, the terms "containers," "boxes," and "trays" are generally used interchangeably herein, and are generally given their art-recognized meanings. Also, for convenience and simplicity, the terms "apparatus," "equipment," "machine," and "component" may be used interchangeably with respect to machinery and/or other equipment suitable for use in manufacturing containers, boxes and/or trays, and wherever one such term is used, it also generally encompasses the other terms. The terms "cutout," "opening," "gap," and "hole" are also generally used interchangeably herein, as are the terms "container blank" and "container wrap," but these terms are generally given their art-recognized meanings. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Use of the same numerals in the Figures (e.g., the same number, an identification number that is the same in the last 2 places, or a number that differs only in the number of primes that follow the numerals) refers to the same or similar structure(s).

The invention, in its various aspects, will be explained in greater detail below with regard to exemplary embodiments. It should be understood that the possible permutations and combinations described herein are not meant to limit the invention.

An Exemplary Stackable Container Blank

Figure 1:
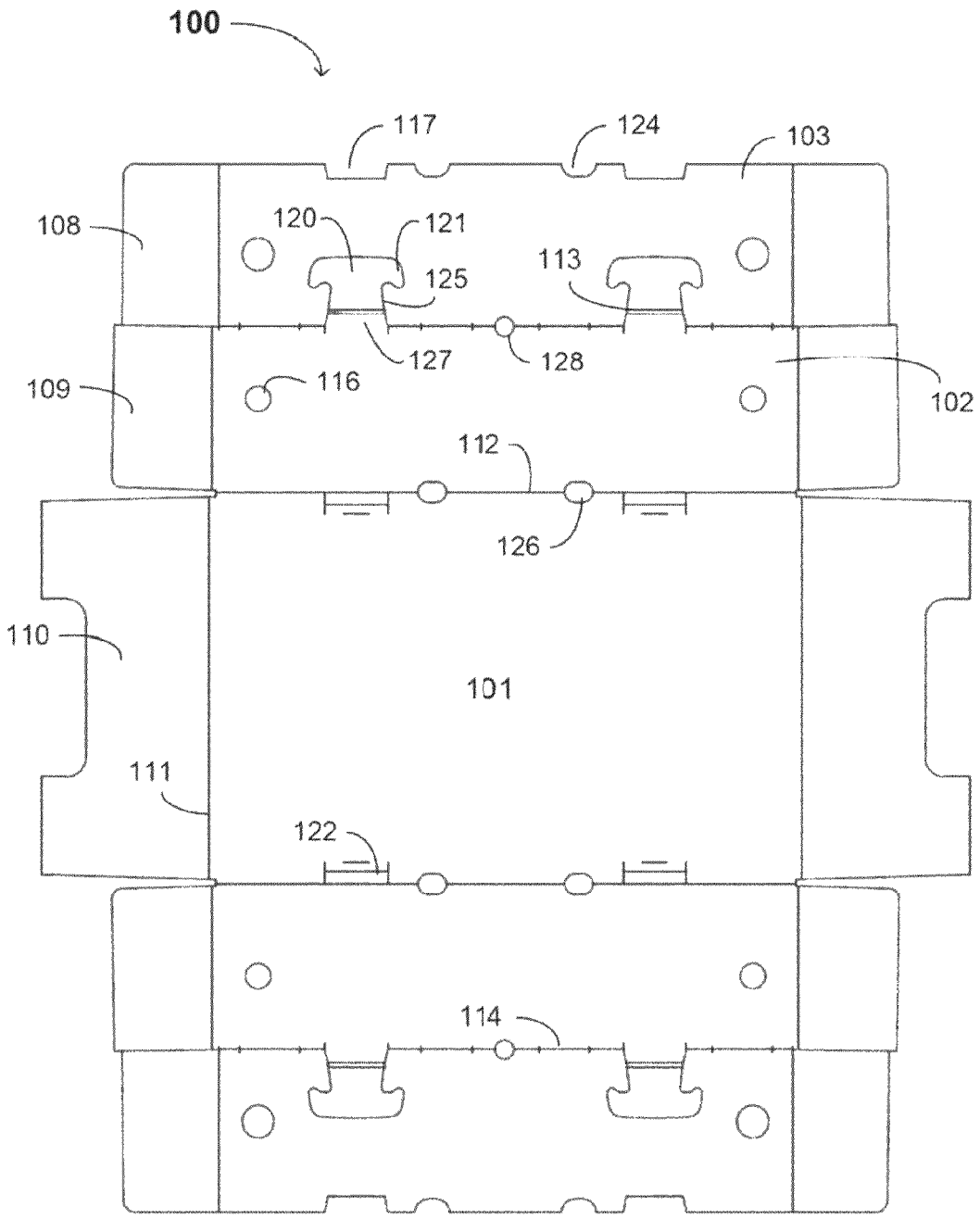
FIG. 1 is a diagram of an exemplary blank for a stackable container in accordance with the present invention.

Referring now to FIG. 1, an exemplary blank 100 suitable for making a stackable container may have a base 101 having a first pair of opposed base edges 111 (typically, but not necessarily, shorter base edges) and a second pair of opposed base edges 112 (typically, but not necessarily, longer base edges). Although the exemplary blank 100 may be made from any material that can be cut, scored, folded, and assembled in the manner described herein, corrugated board is preferred. Such corrugated board generally contains two outer layers of paperboard or cardboard (which generally has a relatively heavy weight), with an inner layer of corrugation (e.g., corrugated paper), but it may contain further layers (e.g., of an external paper or plastic sheet for further support, waterproofing and/or marking, e.g., with advertising and/or identification information; a further inner layer or sheet [e.g., of paper or plastic] between two layers of corrugation; etc.) or contain different materials (e.g., plastic sheet having a relatively high stiffness or modulus of elasticity).

End walls 110 may each be foldably attached to one of the first base edges 111. Side walls may each be foldably attached to one of the second base edges 112. A foldable attachment can be an attachment with a perforation, indentation, score, or other suitable form so as to facilitate a folding of one side of the attachment with respect to the other side of the attachment, while maintaining an attachment or connection between the two sides. For example, in FIG. 1, end walls 110 can be folded to approximately 90 degree angles with respect to base 101 to form walls of the stackable container structure, as will be discussed in more detail below.

Each of the side walls has an outer wall 102 foldably attached to a base edge 112, index fold-down flaps 120 foldably attached to outer wall 102 along a fold line 113, and an inner wall 103 foldably attached to outer wall 102 along fold lines 114. The inner wall 103 may be replaced with a plurality of inner wall fold-down flaps (or inner wall flaps; not shown) with cutouts or removed sections between each index fold-down flap 120 and the outermost edge of the blank 100, such that the inner wall flaps and the index fold-down flaps 120 alternate (i.e., there is an index fold-down flap between each inner wall flap along outer wall 102). The base 101 may include slots 122, and the inner wall 103 may include one or more cutouts 117, each configured to provide slots for indexing with another stackable container. The outer wall 102 and the index fold-down flaps 120 form index tabs or projections configured to fit into the slots 122. In one embodiment, as shown in FIG. 1, each second side wall has two index flaps 120 (thus forming two index tabs or projections on each of the two sides).

The index fold-down flaps 120 include extensions 121 that project or extend a length from a distal end or portion of the index fold-down flap 120, generally in a direction parallel with the second and third fold lines. The length of the extensions 121 is generally sufficient to result in secure fastening of the index fold-down flap 120 under the inner wall 103 when the inner wall 103 is folded. In one embodiment, to reduce or prevent folding or bending of the index tab fold-down flap 120 at a location other than the second fold line 113, each of the index fold-down flaps has a border 125 with the inner wall 103 at a first angle of less than 90° from the second fold line 113. In various examples, the first angle is from 70° to 85° with respect to the second fold line. This angle creates space between the index tab fold-down flap 120 and the corresponding edge of the inner wall 103 during the folding process. Thus, the index fold-down flap 120 may have a width that decreases linearly from the second fold line 113 to the distal portion of the index fold-down flap 120.

Furthermore, as shown in FIG. 1, each outer wall 102 has a portion 127 between the second fold line 113 and the third fold line 114 having a border at a second angle greater than 90° from the second fold line 113. In various embodiments, the second angle is 95° to 110° with respect to the second fold line 113. In preferred embodiments, the sum of the first and second angles is about 180°. Thus, each outer wall 102 may have a portion between the second and third fold lines 113 and 114 having a width that increases linearly from the second fold line 113 to the third fold line 114.

A key feature of the invention is the shape of the extensions 121. For example, extensions 121 may have a first width at a location proximate to the portion of the index fold-down flap 120 distal from the second fold line 113, and a second, greater width at a location distal from the distal portion of the index fold-down flap 120. The second width is, in some examples, at least 10% greater than the first width. In other examples, the second width is at least 20% greater than the first width. The length of the extensions 121 may be, for example, from 50% to 200% of the width of the extension 121 proximate to the distal portion of the index fold-down flap 120.

To reduce or prevent bending of the extensions 121 during the container assembly process, the extensions 121 may have a curved and/or angled edge. For example, as shown in FIG. 1, the extensions 121 may have a concave curved edge at a location proximate to the distal portion of the index fold-down flap 120. In addition, the extensions 121 may have a convex curved edge at a location distal from the distal portion of the index fold-down flap 120. These concave and convex edges may be along a side of the extensions 121 nearest to the second fold line 113, and optionally, a side of the extensions 121 farthest from the second fold line. Alternatively, the extensions 121 may have an edge nearest to the second fold line 113 that is at an angle of less than 85-90° (e.g., 45-80°, or any angle or range of angles therein that brings the nearest edge of the index tab extension 121 at the distal end closer to the third fold line 114 than at the end proximate to the index tab fold-down flap 120) with respect to the slanted edge 125 of the index tab fold-down flap 120. In some examples, the extensions 121 have a knob-like or hook-like shape (e.g., a hook shape or point, as shown in FIG. 1).

Preferably, the flutes (e.g., channels in the corrugation) are vertical in the load-bearing wall. In blank 100, side walls 102-103 may be folded to form the load-bearing wall. Thus, the flutes of the corrugated board forming the blank should be oriented perpendicularly to fold line 112. The fold lines between the outer wall 102 and the index flaps 120 and inner walls 103 (e.g., the second and third fold lines) are generally parallel to the fold line between the outer wall 102 and the base 101 (e.g., the first fold line). The distance between the first fold line 112 and the second fold lines 113 (e.g., including the index tab) is greater than the distance between the first fold line 111 and the third fold lines 114 (e.g., the height of the folded side wall). Thus, when the index fold-down flaps are folded over the outer wall, they form a projection above the fold line of the inner wall.

In a further embodiment, the height and width of the inner wall 103 is substantially equal to a width of the outer wall 102 (e.g., excluding the height of the projection or tab formed by the index fold-down flap 120). Alternatively, the width of the inner wall is slightly less than the width of the outer wall. The edges of the index fold-down flaps 120 and edges of cutouts 226 (see FIG. 2) in the inner walls 103 are separated by cut-lines in the blank. Thus, each index fold-down flap may be separated from its neighboring inner wall by such a cut-line.

Each of the side walls (e.g., outer wall 102) also includes first extension flaps (e.g., extension flaps 109) foldably attached to each side wall, along first extension fold lines approximately parallel with the first base edges 111. Second extension flaps 108 may be foldably attached to the inner wall 103 along second extension fold lines approximately parallel with the first base edges 111. The first and second extension flaps generally extend beyond lines formed by the base edges 111.

The outer and inner walls 102, 103 may each have one or more holes 116 therein. When the inner wall 103 is folded over the outer wall 102, the holes 116 may overlap or otherwise be configured to provide an opening for air to flow through the container, for example. The width at the top of the holes may be greater than the width of the bottom of the holes (e.g., the holes may have a generally triangular shape with an apex nearest the fold line between the index flap and the outer wall). This triangular configuration may provide for improved strength of the folded wall structure (e.g., as opposed to round or rectangular air holes in the same position).

Also included in exemplary stackable container blank 100 are indentations or cutouts 124. Cutouts 124 may substantially coincide with holes 126 when the inner wall 103 is folded onto the outer wall 102. In addition, blank 100 may include cutouts 128 along the foldable attachment between inner and outer walls 102, 103. Such cutouts 128 may further assist air flow over produce within the assembled container and/or enable access to a lower surface of an overlying stacked container for ease in lifting (e.g., un-stacking) such stacked containers. Furthermore, the base 101 of the exemplary stackable container blank 100 may include one or more holes or slots 122 configured to receive an index tab from another stackable container. Generally, each slot 122 has a width equal to or greater than the length of the second fold line 113 (e.g., the width of the index tab 220 in FIGS. 2A-B). The outer wall 102 and the index fold-down flaps 120 form index tabs or projections (e.g., index tabs 220) configured to fit into the slots 122.

An Exemplary Stackable Container

Figure 2A:
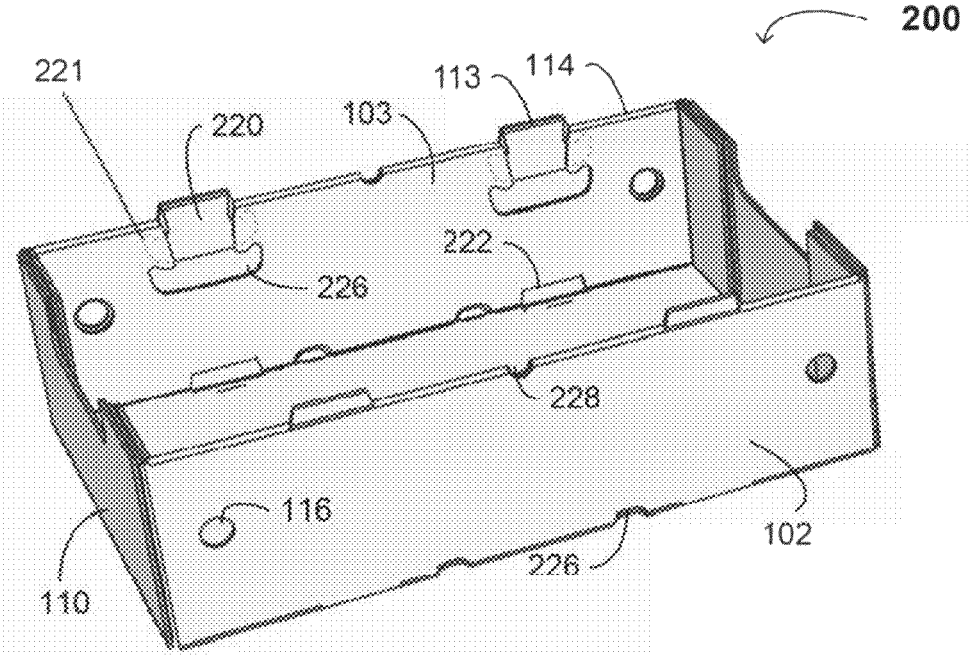
FIG. 2A is a diagram of a stackable container according to an embodiment of the present invention.

Referring now to FIG. 2A, an exemplary stackable container 200, made from the exemplary blank 100, is shown. End walls 110 are folded at an angle of from about 80° to about 100° (e.g., from 90° to about 100°) at the base edges 111. Side walls that include an outer wall 102 folded at an angle of from about 90° to about 100° (e.g., 92°-95°) at base edge 112, index fold-down flaps 120 folded at an angle of about 180 degrees along fold lines 113 (e.g., folded over outer wall 102), and an inner wall 103 folded at an angle of about 180 degrees along fold lines 114. The inner wall has a border with the index fold-down flap (e.g., index fold-down flap 120) at a third angle with respect to the third fold line 114, and the sum of the first and third angles is substantially equal to 180°. The side walls may thus be substantially vertical, or inclined at an angle of from 90 to 100° (preferably, an angle of from 92 to 95°) to accommodate the indexing functionality.

Figure 2B:
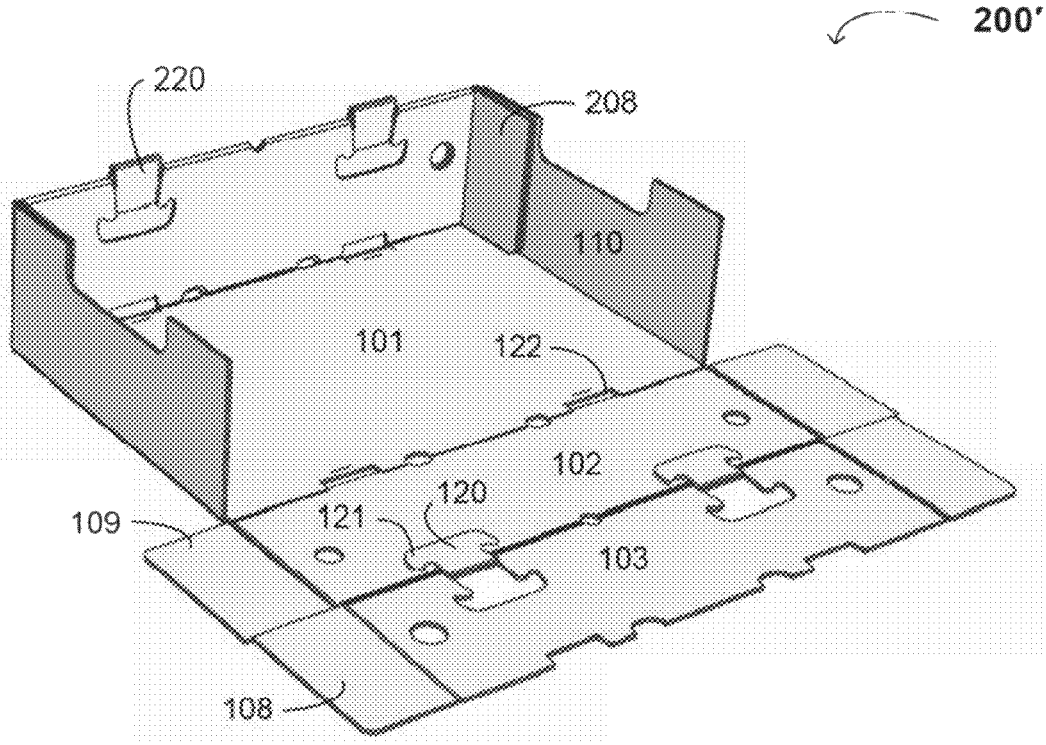
FIG. 2B is a diagram of the exemplary stackable container according to FIG. 2A, with one side wall unfolded.

The outer wall 102 and index fold-down flaps 120 form an index tab 220 when the index fold-down flap 120 is folded along fold line 113 at an angle of about 180°. Each index fold-down flap 120 has notched or expanding extensions 121 that extend from a distal portion of the index fold-down flap 120, as shown in FIG. 2B. The inner wall 103 (which can be replaced with a plurality of inner wall flaps as described herein) is folded along the fold line 114 at an angle of about 180°. The notched or expanding extensions 121 are between the inner and outer walls 102, 103. The fold line 114 is closer to the fold line 112 than is the fold line 113.

When the container is assembled, each of the notched or expanding extensions 121 contacts an inner surface of the outer wall 102. Generally, the notched or expanding extensions 121 also contact an inner surface of the inner wall 103, shown by the dashed lines 221 in FIG. 2A. This arrangement secures the index fold-down flaps 120 in place, with or without adhesive (although use of an adhesive between the index fold-down flap 120 and at least the outer wall 102 is generally recommended).

The base 101 may include one or more holes or slots 122 configured to receive an index tab from another stackable container. The outer wall 102 and the index fold-down flaps 120 form index tabs or projections configured to fit into the slots 122. Inner and outer walls 102, 103 may have one or more holes 116 to provide an opening for air to flow through the container 200. The height of the inner wall 103 is substantially equal to a height of the outer wall 102 (e.g., excluding the height of the projection formed by the index fold-down flap).

As mentioned above, stackable container blank 100 may be substantially made from a corrugated paper material, for example. Further, when a stackable container 200 is made from the exemplary blank 100, an adhesive material or glue may be used to secure different portions, flaps, and/or extensions together. For example, index fold-down flaps 120 may be glued or otherwise adhesively attached to the outer wall 102, and the inner wall 103 may be glued or otherwise adhesively attached to the outer wall 102 as well. Further, extensions 109 may be glued or otherwise adhesively attached to end walls 110, and extensions 108 may be glued or otherwise adhesively attached to extensions 109.

Each of the outer walls 102 also includes first extension flaps (not visible in FIG. 2A) at an angle of about 90 degrees to each of the outer wall 105 and the end wall 110, such that the first extension flaps are parallel with the end wall. Second extension flaps 108, foldably attached to the inner wall 103 at ends of the inner wall closest to the end walls 110, are at an angle of about 90° with respect to the inner wall 103 such that the second extension flaps 109 are parallel to the first extension flap 108 and to the end wall 110. In an alternative embodiment, each extension flap 109 may be adhesively attached to a first surface (e.g., an outer surface) of an end wall 110, and each extension flap 108 may be adhesively attached to a second surface (e.g., an inner surface) of the end wall, thus "sandwiching" each end wall 110 between two extension flaps.

While the exemplary embodiment 200 shown in FIG. 2A includes a rectangular base and particular angles and extension sizes, one skilled in the art will recognize that other base configurations (e.g., square), wall and extension angles, and wall/extension sizes may also be used in accordance with embodiments. Further, one skilled in the art will recognize that other means of attachment (e.g., besides glue) may also be used in accordance with various embodiments.

Exemplary Method of Making a Stackable Container

Figure 3A:
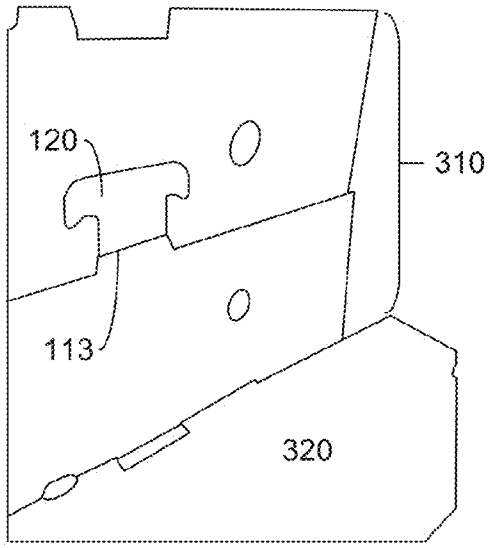
FIGS. 3A-3C are photographs showing the folding sequence for side walls (or panels) according to one or more embodiments of the present invention.
Figure 3B:
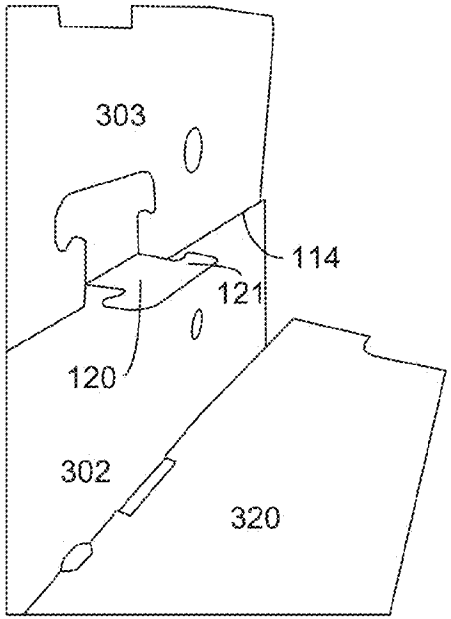
Figure 3C:
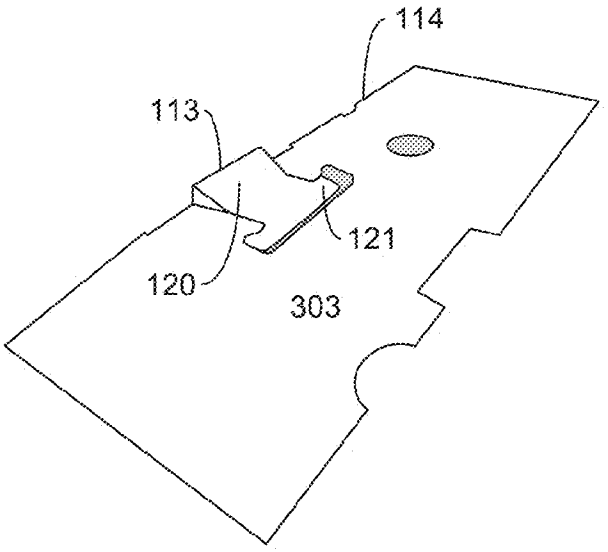
Figure 4:
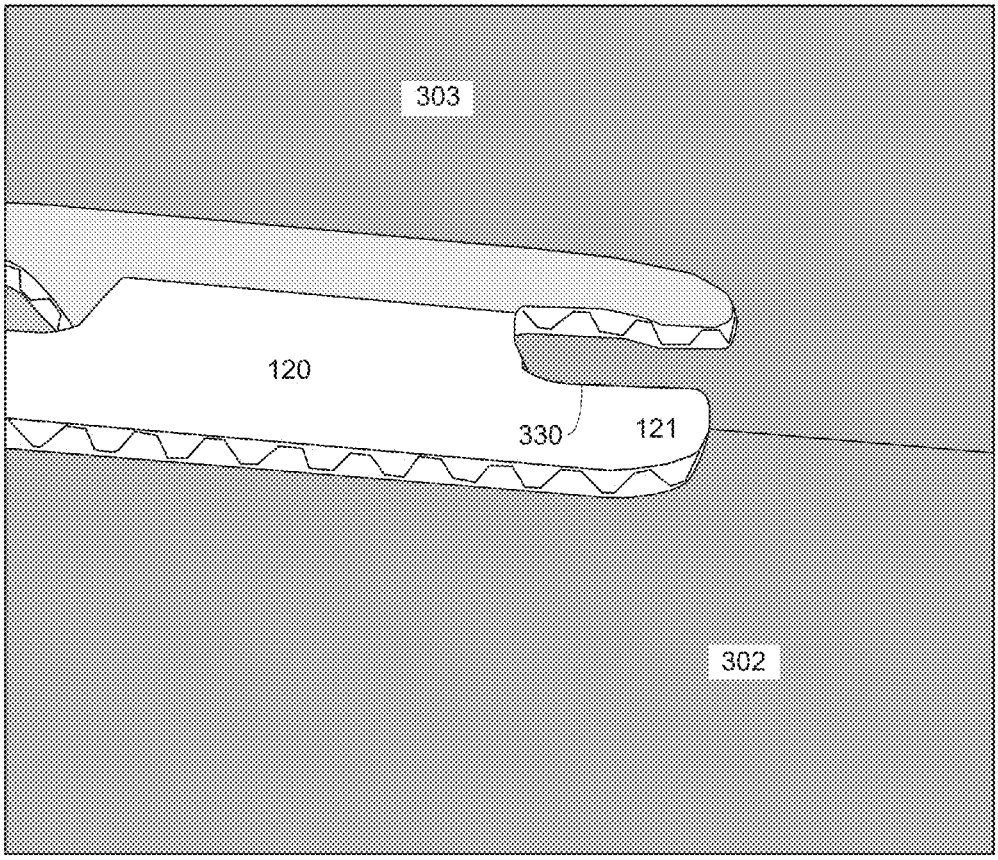
FIG. 4 is a photograph of an exemplary index tab fold-down flap and portions of inner and outer side walls (or panels) during the exemplary folding sequence, showing the reduced contact between the index tab fold-down flap extension and the inner side wall.

A container blank (e.g., a container blank such as blank 100 of FIG. 1 or any other stackable container blank according to the present invention) is formed. The blank is generally as described herein. As shown for example in FIG. 3A, two opposing end wall structures (e.g., 310) are folded to form an angle of, for example, about 80° to about 100° with respect to the base (e.g., 320) of the blank. Thereafter, the index fold-down flap(s) 120 are folded along the fold line 113 with the outer wall 302 to form an angle of about 30°-150° (e.g., 80°-100°) with respect to the outer wall 302 (see, e.g., FIG. 3B). Third, the inner wall 303 is folded along the fold line 114 with the outer wall 302 (FIG. 3C) so that the index flap extensions 121 are at least partially under the inner wall 303. As shown in FIG. 4, as the inner wall 303 is folded over the index tab fold-down flap 120 the inner surface of the inner wall 303 contacts the point or tip provided by the curved portion of the index tab extension 121, creating an area of clearance 330 that reduces or eliminates pressure from the inner wall 303 on the bulk or entirety of the index tab extension 121.

The inner wall 303 is folded to form an angle of about 180° with respect to the outer wall 302. At this point, the index tab 120, which projects above the fold line 114 between the inner and outer walls 302, 303, is formed and secured by the index flap extensions 121 between the inner and outer walls 302, 303. As a result, both the extension 121 and the index tab fold-down flap 120 are less likely to bend or fold in a location that damages or weakens the index tab (e.g., 220 in FIG. 2B).

In general, prior to folding, an adhesive is applied to one or more surfaces that will come into contact with another surface after folding. Pressure and/or heat may be applied to outer surfaces of the folded, adhesive-applied features after coming into contact with each other.

The method then folds the first and second extension flaps at an angle of about 90° with respect to the outer and inner walls, such that the first and second extension flaps are approximately parallel to the first side wall structures. The first extension flaps may be adhesively attached to an end wall, and the second extension flap may be adhesively attached to the first extension flap (e.g., sandwiching each first extension flap between an end wall structure and a second extension flap). Alternatively, the method may include adhesively attaching the first and second extension flaps to opposite surfaces of the end walls (e.g., sandwiching each end wall structure between first and second extension flaps).

The adhesive attaching can be done by applying an adhesive substance or glue to a surface of either of the first and second pairs of opposed walls/flaps, for example. Further, one or more of these steps can be performed in automated fashion. For example, a machine (e.g., a box erector) can be used to form a stackable container from a blank, where the blank was made using another machine. Alternatively, a single machine may be used to form the blank (e.g., a die cutter and/or a score), and then form the stackable container (e.g., compressor machines to push portions and/or extensions together) from the blank. As another alternative, several machines can be used to perform various portions of the method.

CONCLUSION

The present invention advantageously provides a reliable design and/or approach for making a stackable container from a blank, whereby extensions on the index tabs help to secure the index tabs in place, and reduce the risk of damage to the index tabs. Furthermore, the present index tabs and index tab extensions do not bend or fold as easily (e.g., in places where they are not intended to fold), which improves the production yield of containers having such index tabs with securable extensions and increases the useful lifetime of such index tabs. In addition, flutes on the load-bearing wall and on index tabs for stacking the containers may also be covered, thereby reducing moisture collection in the load-bearing walls of the container.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A container blank comprising:

a) a base having a first pair of opposed base edges and a second pair of opposed base edges;

b) end walls, each end wall foldably attached to one of said first base edges; and c) side walls, each side wall foldably attached to one of said second base edges, wherein each of said side walls comprises:

i) an outer wall foldably attached to said second base edge along a first fold line;

ii) at least one index fold-down flap attached to said outer wall along a second fold line, each index flap having (a) a distal portion with notched or expanding extensions or (b) a border at a first angle of less than 90° from said second fold line and a distal portion with extensions therefrom, wherein said extensions have a concave curved edge at a location proximate to said distal portion and a convex curved edge at a location distal from said distal portion and iii) an inner wall or a plurality of inner wall flaps, foldably attached to said outer wall along a third fold line, wherein said third fold line is closer to the first fold line than is the second fold line.

2. The container blank of claim 1, wherein each of said index fold-down flaps has a border at a first angle of less than 90° from said second fold line.

3. The container blank of claim 1, wherein said index fold-down flap has a width that decreases linearly from the second fold line to the distal portion.

4. The container blank of claim 1, wherein each of said extensions have a first width at said location proximate to said distal portion and a second width at said location distal from said distal portion, and said second width is greater than said first width.

5. The container blank of claim 1, wherein said extensions are covered by said inner wall or at least one of said inner wall flaps when said index fold-down flaps and said inner wall or said inner wall flap(s) are folded.

6. The container blank of claim 1, wherein said base comprises one or more slots configured to receive a folded index tab of another container, and said slot has a width equal to or greater than a length of said second fold line.

7. The container blank of claim 1, wherein said inner wall has a border with said index fold-down flap at a third angle with respect to said third fold line, and a sum of the first and third angles is substantially equal to 180°.

8. A stackable container comprising:

a) a base having a first pair of opposed base edges and a second pair of opposed base edges;

b) end walls, each end wall foldably attached to said first base edges at an angle of from about 80° to about 100°; and c) side walls, each side wall foldably attached to one of said second base edges, wherein each of said side walls comprises:

i) an outer wall foldably attached to said second base edge along a first fold line at an angle of from about 90° to about 100°, ii) at least one index tab comprising an index fold-down flap foldably attached to said outer wall along a second fold line at an angle of about 180°, each index fold-down flap having a distal portion with notched or expanding extensions therefrom, said extensions having a concave curved edge at a location proximate to said distal portion and a convex curved edge at a location distal from said distal portion, and optionally, a border at a first angle of less than 90° from said second fold line; and iii) an inner wall or a plurality of inner wall flaps foldably attached to said outer wall along a third fold line at an angle of about 180°, said notched or expanding extension being between the inner and outer walls, and the third fold line being closer to the first fold line than is the second fold line.

9. The stackable container of claim 8, wherein each of said notched or expanding extensions contacts a first surface of said outer wall and a first surface of either said inner wall or one of said inner wall flaps to secure said index fold-down flap in place, said first surfaces of said outer wall and said inner wall or said one of said inner wall flaps facing each other.

10. The stackable container of claim 8, wherein each of said index fold-down flaps has a border at a first angle of less than 90° from said second fold line.

11. The stackable container of claim 8, wherein said index fold-down flap has a width that decreases linearly from the second fold line to the distal portion.

12. The stackable container of claim 8, wherein each of said extensions have a first width at said location proximate to said distal portion and a second width at said location distal from said distal portion, and said second width is greater than said first width.

13. The stackable container of claim 8, wherein said base comprises one or more slots configured to receive the index tab of another container.

14. A method of making a stackable container, comprising:

a) folding two opposing end walls of a stackable container blank to form angles of about 80° to about 100° with respect to a base at a first pair of opposed edges of the base;

b) folding side walls at a second pair of opposed base edges along a first fold line to form an angle of about 90° to about 100° with respect to said base;

c) folding one or more index fold-down flaps foldably attached to an outer wall of said side wall along a second fold line at an angle of about 30°-150°, each index fold-down flap having a distal portion with notched or expanding extensions therefrom, said extensions having a concave curved edge at a location proximate to said distal portion and a convex curved edge at a location distal from said distal portion; and d) for each of said side walls, folding an inner wall or a plurality of inner wall flaps foldably attached to said outer wall along a third fold line at an angle of about 180° with respect to said outer wall to form an index tab from the index fold-down flap, the notched or expanding extensions being between the inner and outer walls, and said third fold line being closer to the first fold line than is the second fold line.

15. The method of claim 14, further comprising forming slots in said base at first fold line at positions corresponding to said index tabs.

16. The method of claim 14, further comprising affixing first extension flaps foldably attached to each of said outer walls to said end walls at an angle of about 90° with respect to said outer walls, such that said first extension flaps are approximately parallel to said end walls.

17. The method of claim 14, further comprising affixing second extension flaps foldably attached to each of said inner walls or to outermost ones of said inner wall flaps to either said end walls or to said first extension flaps at an angle of 90° with respect to said side wall, such that said second extension flaps are parallel with said first extension flaps and said end walls.

* * * * *